US006334489B1

(12) United States Patent
Shwe et al.

(10) Patent No.: US 6,334,489 B1
(45) Date of Patent: Jan. 1, 2002

(54) DETERMINING SUBSURFACE FLUID PROPERTIES USING A DOWNHOLE DEVICE

(75) Inventors: Than Shwe, Houston; Mike Flecker, Sugar Land; Steve Thompson; Roy Torrance, both of Houston, all of TX (US)

(73) Assignee: Wood Group Logging Services Holding Inc., Houston, TX (US)

( * ) Notice: Subject to any disclaimer, the term of this patent is extended or adjusted under 35 U.S.C. 154(b) by 0 days.

(21) Appl. No.: 09/356,848

(22) Filed: Jul. 19, 1999

(51) Int. Cl.[7] ..... E21B 49/08
(52) U.S. Cl. ..... 166/250.01; 166/66
(58) Field of Search ..... 166/250.01, 264, 166/163, 169, 66; 73/155

(56) References Cited

U.S. PATENT DOCUMENTS 4,583,595 A * 4/1986 Czernichow et al. ..... 166/264
4,940,088 A * 7/1990 Goldschild ..... 166/109
5,303,775 A * 4/1994 Michaels ..... 166/164
5,329,811 A * 7/1994 Schultz ..... 73/155
5,473,939 A 12/1995 Leder et al.
5,609,205 A * 3/1997 Massie et al. ..... 166/163
5,635,631 A 6/1997 Yesudas et al. .....

* cited by examiner

*Primary Examiner*—Frank Tsay
(74) *Attorney, Agent, or Firm*—Todd Mattingly; Haynes and Boone, LLP

(57) ABSTRACT

A system, apparatus, and method for determining real time bubble point pressure and compressibility of a fluid originating from a subsurface earth formation during well production first permit remote collection of a sample of fluid. The sample of fluid is then remotely expanded, while the temperature, pressure, and volume of the sample of fluid are remotely monitored. The real time bubble point pressure and compressibility of the sample of fluid are extracted from a plot of sample fluid pressure versus volume, which exhibits substantially linear behavior having two different slopes.

2 Claims, 7 Drawing Sheets

DETERMINING SUBSURFACE FLUID PROPERTIES USING A DOWNHOLE DEVICE

TECHNICAL FIELD

This invention relates generally to the field of downhole tools, and, more particularly, to downhole tools used for determining real time properties of fluids originating from subsurface earth formations.

BACKGROUND OF THE INVENTION

Electric downhole tools are used for determining various properties of fluids originating from subsurface earth formations. Conventional methods of using these devices involve using the tool to first withdraw a sample of fluid from a subsurface earth formation into a sample chamber of the tool. Thereafter, the volume of the sample chamber is incrementally increased, while the device measures the pressure, volume, and temperature of the sample. These measurements provide data for calculating fluid properties, such as bubble point pressure and compressibility. Unfortunately, these conventional tools are not operable during well production, and must be removed from a wellbore prior to flowing the well.

Accordingly, the present invention is directed to overcoming one or more of the limitations of the existing devices.

SUMMARY OF THE INVENTION

An apparatus for determining real time bubble point pressure of a fluid originating from a subsurface earth formation includes a sample chamber adapted to contain a sample of the fluid. A piston in the sample chamber adjusts the volume of the sample chamber. A pressure/temperature gauge fluidicly couples to the sample chamber, and monitors the pressure and temperature of the fluid sample within the sample chamber. A controller operably couples to the piston and pressure/temperature gauge. The controller continuously monitors the pressure, temperature, and volume of the sample fluid during expansion of the sample chamber. The controller also determines the bubble point pressure of the fluid, based on the pressure and volume measurements.

According to another aspect of the present invention, the controller of the same apparatus is also adapted to determine the compressibility of the sample fluid based on the pressure and volume measurements.

According to another aspect of the present invention, a method of determining real time bubble point pressure of a fluid originating from a subsurface earth formation includes first sampling the fluid during well production. After sample collection, the volume of the sample fluid is then incrementally increased, while the pressure, temperature, and volume of the sample fluid are monitored. The bubble point pressure of the sample fluid is then extrapolated from a graph of the pressure and volume measurements.

According to another aspect of the method of the present invention, after the step of monitoring, the compressibility of the sample fluid is then determined from a graph of the pressure and volume measurements.

According to another aspect of the present invention, a system for determining real time bubble point pressure of a fluid originating from a subsurface earth formation includes a production tubing adapted to facilitate the flow of fluid to the surface. A side pocket couples to the production tubing, and contains a downhole device. The downhole device is adapted to expand a sample of fluid. The downhole device is also adapted to measure the temperature and pressure of the sample of fluid. A remote controller, at the surface or downhole, operably couples to the downhole device. The controller is adapted to monitor the temperature, pressure, and volume of the sample of fluid. The controller is also adapted to determine the bubble point pressure of the fluid based on the pressure and volume measurements.

According to another aspect of the present invention, the controller of the same system is also adapted to determine the compressibility of the fluid, based on the pressure and volume measurements.

DETAILED DESCRIPTION OF THE PREFERRED EMBODIMENT

The system, apparatus, and method of the present invention permit remote collection of a sample of wellbore fluid during well production. Following sample collection, the system, apparatus, and method permit remote expansion of the sample, as the temperature, pressure, and volume of the sample are monitored. The system, apparatus, and method then use the pressure and volume measurements to determine the real time bubble point pressure and compressibility of the sample of wellbore fluid.

Figure 1:
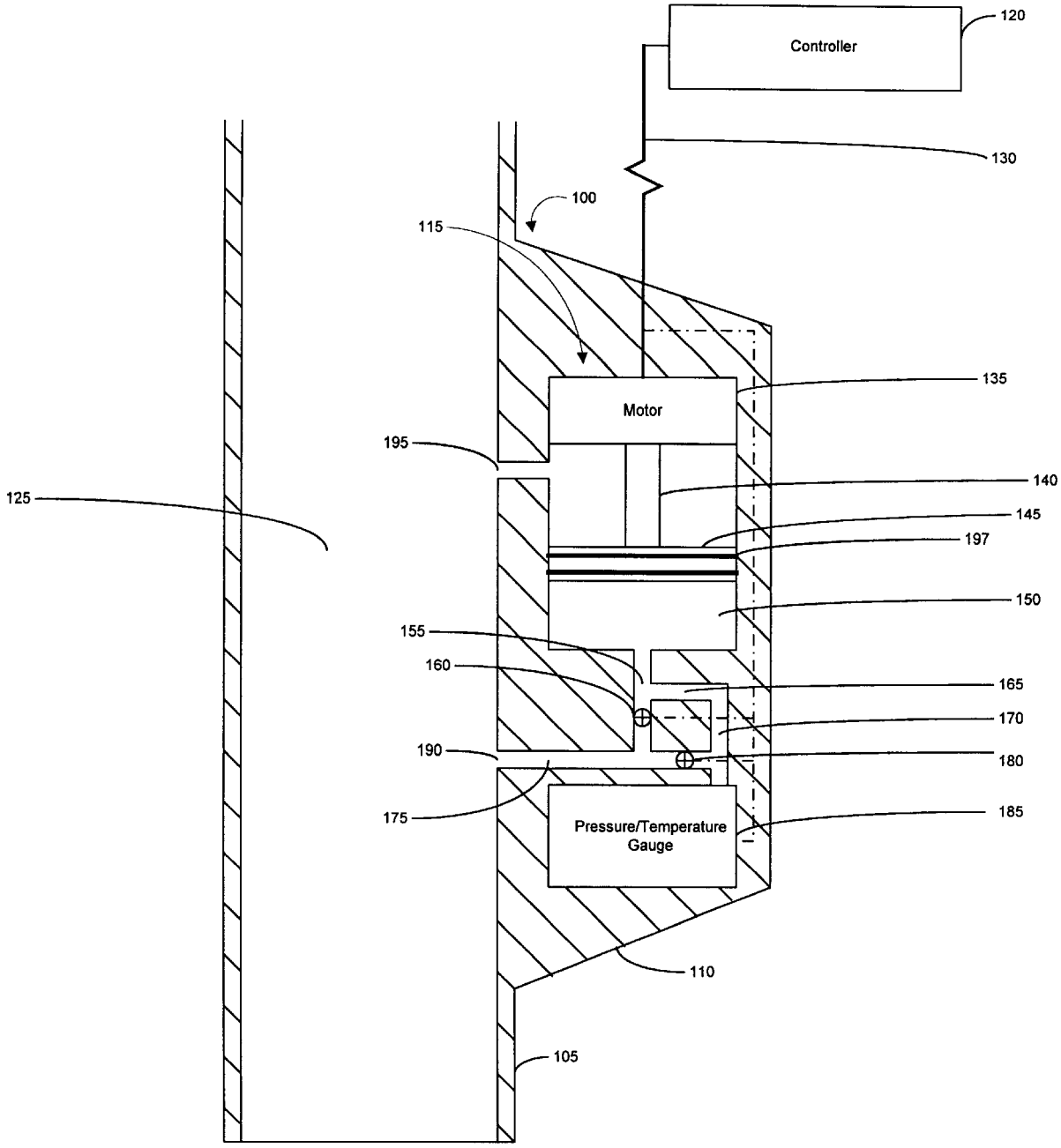
FIG. 1 depicts a fragmentary cross-sectional view of a preferred embodiment of an apparatus for determining bubble point pressure and compressibility of a downhole fluid.

Referring to FIG. 1, a system 100 for determining various properties of subsurface earth formation fluid includes a production tubing 105, a side pocket 110, a downhole device 115, and a controller 120.

The production tubing 105 includes a fluid passage 125. The fluid passage 125 facilitates the flow of fluid originating from a subsurface earth formation to the surface. The production tubing diameter will vary depending upon the size and productivity of the well.

The side pocket 110 couples to and is supported by the production tubing 105. The side pocket 110 houses the downhole device 115.

The downhole device 115 couples to and is supported by the production tubing 105. The downhole device 115 includes a wireline 130, a motor 135, a spindle 140, a piston 145, a sample chamber 150, a first flow line 155, a first solenoid valve 160, a second flow line 165, a third flow line 170, a fourth flow line 175, a second solenoid valve 180, a pressure/temperature gauge 185, an inlet port 190, and a pressure equalization port 195.

The wireline 130 operably couples to the controller 120, the motor 135, the first solenoid valve 160, the second solenoid valve 180, and the pressure/temperature gauge 185.

The motor 135 connects to the spindle 140. The motor 135 moves the spindle 140. The motor 135 comprises a 30 DC volt motor that has an outer diameter dimension of about 1.0 inch and a length of about 3.0 inches.

The spindle 140 connects to the piston 145. The piston 145 adjusts the volume of the sample chamber 150. The piston 145 is stainless steel, and has outer diameter dimension of about 0.75 inches. A plurality of annular piston rings 197 couple to the piston 145. The annular piston rings 197 form a seal between the inner diameter of the sample chamber 150 and the piston 145.

The sample chamber 150 couples to the lower edge of the motor 135. The sample chamber 150 houses the spindle 140 and piston 145. The sample chamber is adapted to contain a sample of fluid. The sample chamber 150 is stainless steel, and has an outer diameter dimension of about 1.0 inch, an inner diameter dimension of about 0.75 inches, and a length of about 3.0 inches.

The pressure equalization port 195 is located in the upper region of the sample chamber 150. The pressure equalization port 195 is a channel that connects the sample chamber 150 to the fluid passage 125 of the production tubing 105. The pressure equalization port 195 functions to minimize the pressure difference across the piston 145. The pressure equalization port 195 has an inner diameter of about 0.25 inches.

The first flow line 155 connects at an upper end to a lower portion of the sample chamber 150 and at a lower end to the fourth flow line 175. The first flow line 155 extends substantially vertically downward from the sample chamber 150. The first flow line 155 fluidicly connects the sample chamber 150 to the fourth flow line 175 and the second flow line 165. The first flow line 155 is adapted to contain a sample of fluid. The first flow line 155 is stainless steel tubing with an outer diameter dimension of about 0.25 inches and an inner diameter dimension of about 0.1875 inches.

The first solenoid valve 160 couples to the first flow line 155. The first solenoid valve 160 opens and closes the first flow line 155. The first solenoid valve 160 is a stainless steel valve.

The second flow line 165 connects at one end to the first flow line 155 and at the other end to the third flow line 170. The second flow line 165 extends in a substantially horizontal direction. The second flow line 165 fluidicly connects the first flow line 155 to the third flow line 170. The second flow line 165 is adapted to contain a sample of fluid. The second flow line 165 is stainless steel tubing with an outer diameter dimension of about 0.25 inches and an inner diameter dimension of about 0.1875 inches.

The third flow line 170 connects at an upper end to the second flow line 165 and at a lower end to the pressure/temperature gauge 185 and the fourth flow line 175. The third flow line 170 extends substantially vertically downward from the second flow line 165. The third flow line 170 fluidicly connects the second flow line 165 to the pressure/temperature gauge 185. The third flow line 170 is stainless steel tubing with an outer diameter dimension of about 0.25 inches and an inner diameter dimension of about 0.1875 inches.

The pressure/temperature gauge 185 fluidicly connects to the third flow line 170. The pressure/temperature gauge 185 monitors the pressure and temperature of the fluid sample within the sample chamber 150. The pressure/temperature gauge 185 is a product designated by model number TMC20K, manufactured by Quartzdyne, Inc. in Salt Lake City, Utah.

The fourth flow line 175 fluidicly connects at one end to the third flow line 170 and on the other end to the inlet port 190. The fourth flow line 175 also connects to the first flow line 155. The fourth flow line 175 extends in a substantially horizontal direction. The fourth flow line 175 connects the third flow line 170 and the first flow line 155 to the inlet port 190. The fourth flow line 170 is stainless steel tubing with an outer diameter dimension of about 0.25 inches and an inner diameter dimension of about 0.1875 inches.

The second solenoid valve 180 is connects to the fourth flow line 175. The second solenoid valve 180 opens and closes the fourth flow line 175. The second solenoid valve 180 is a stainless steel valve.

The inlet port 190 connects to the fourth flow line 175. The inlet port 190 is an opening that connects the fourth flow line 175 to the fluid passage 125 of the production tubing 105. The inlet port 190 facilitates the withdrawal of fluid from the fluid passage 125 into the sample chamber 150 and the flow lines 155, 165, 170, and 175. The inlet port 190 has an inner diameter of about 0.25 inches.

The controller 120 operably couples to the downhole device 115 through the wireline 130. The controller 120 remotely operates the downhole device 115. The controller 120 continuously monitors the pressure, temperature, and volume of the sample fluid during expansion of the sample chamber 150. The controller 120 determines the bubble point pressure and compressibility of the sample fluid based on the pressure and volume measurements. The controller 120 can be any conventional, commercially available programable controller or a computer.

Figure 2:
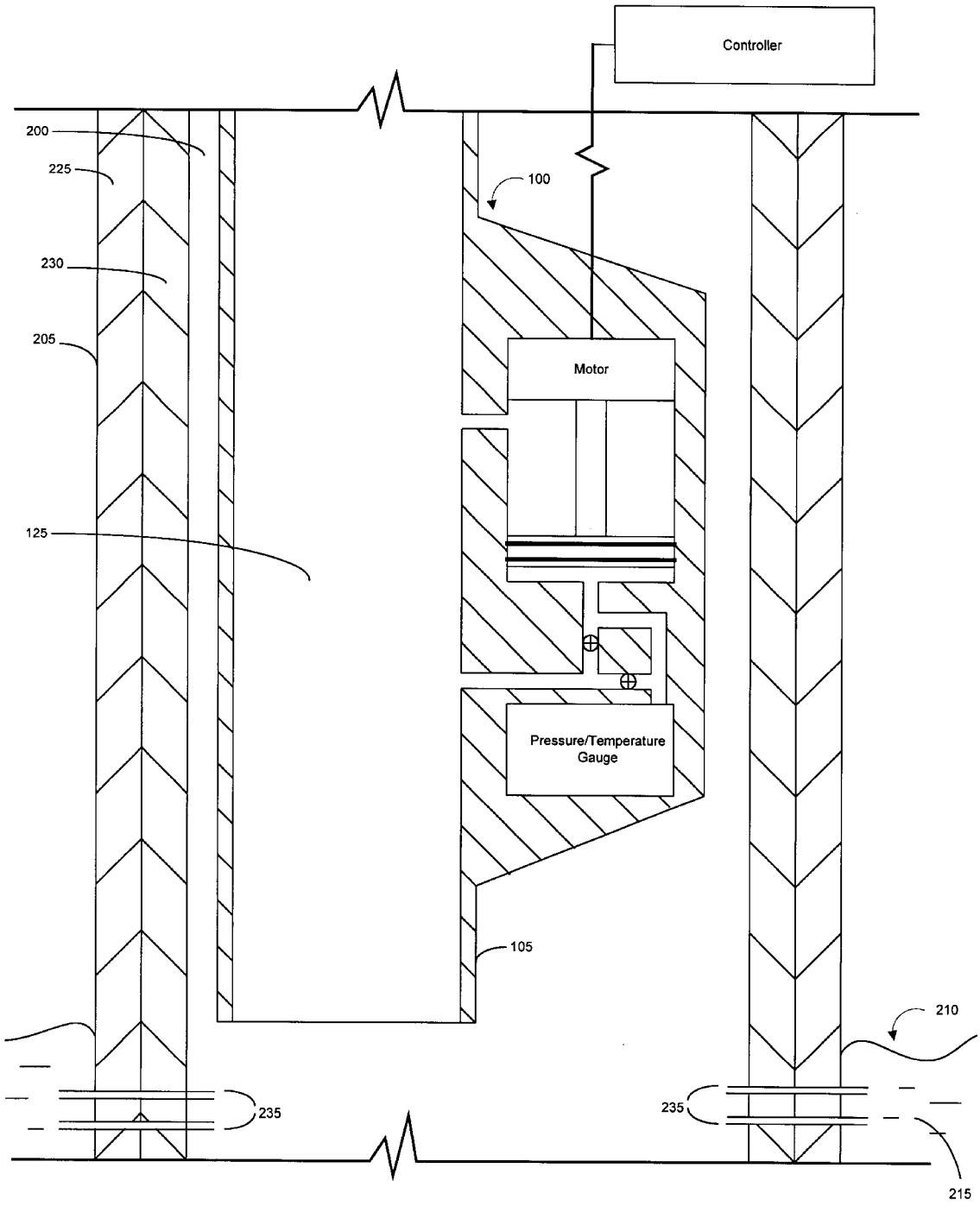
FIG. 2 depicts another fragmentary cross-sectional view of the preferred embodiment of FIG. 1.

Referring to FIG. 2, in operation, an operator first positions the system 100 within a wellbore 200. The wellbore 200 includes a hole 205 extending into a subsurface earth formation 210 containing a formation fluid 215. The wellbore 200 is lined with cement 225 and a casing 230. Perforations 235 adjacent to the formation 210 allow formation fluid 215 to flow into the fluid passage 125 of the production tubing 105.

Figure 3:
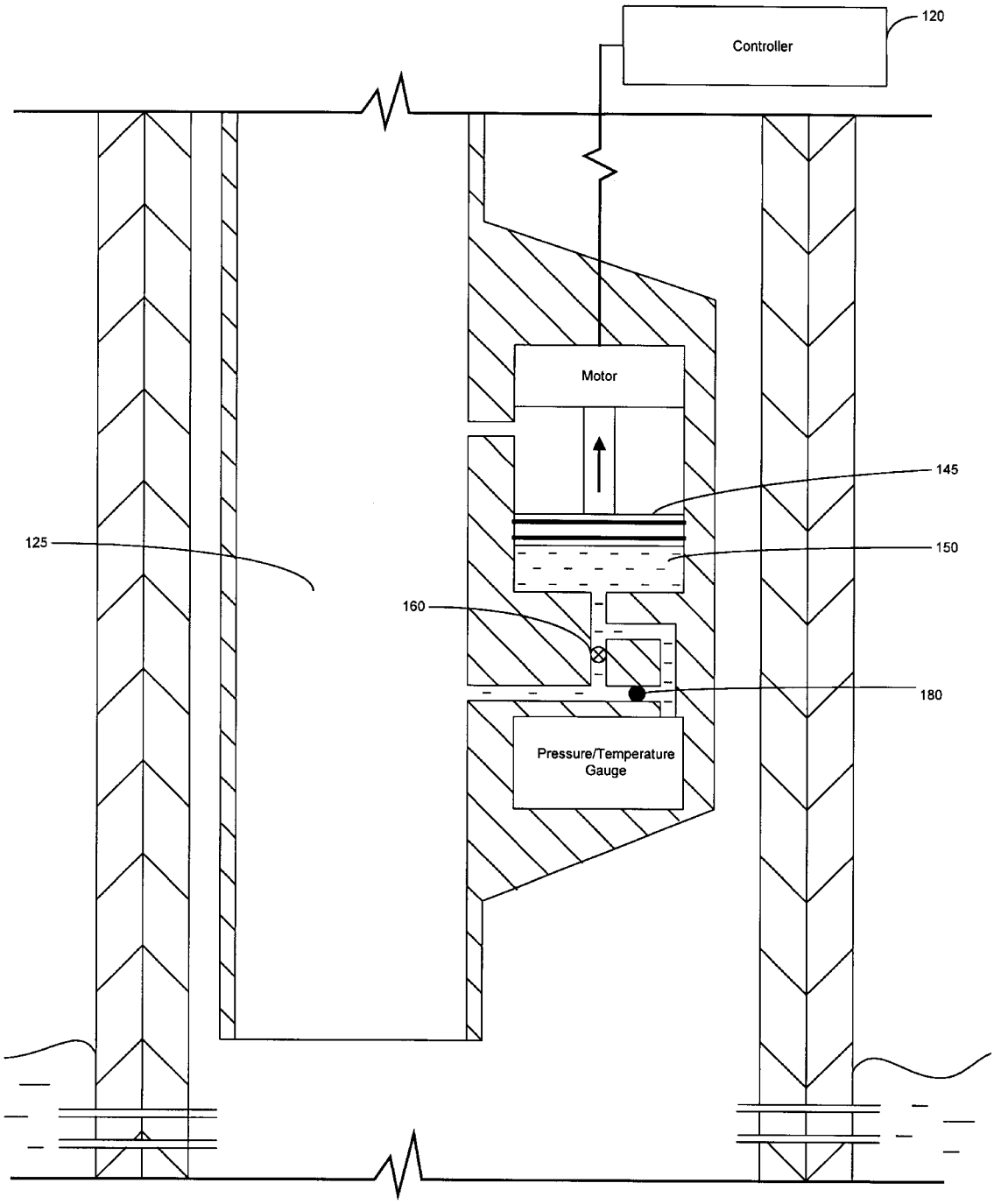
FIG. 3 depicts a fragmentary cross-sectional view of the preferred embodiment of FIG. 1 during sample collection.

Referring to FIG. 3, to collect a sample of fluid, the controller 120 remotely opens the first solenoid valve 160, closes the second solenoid valve 180, and vertically moves the piston 145. The controller 120 continues to vertically move the piston 145 upward until a predetermined volume of fluid has been withdrawn from the fluid passage 125 into the sample chamber 150.

Figure 4:
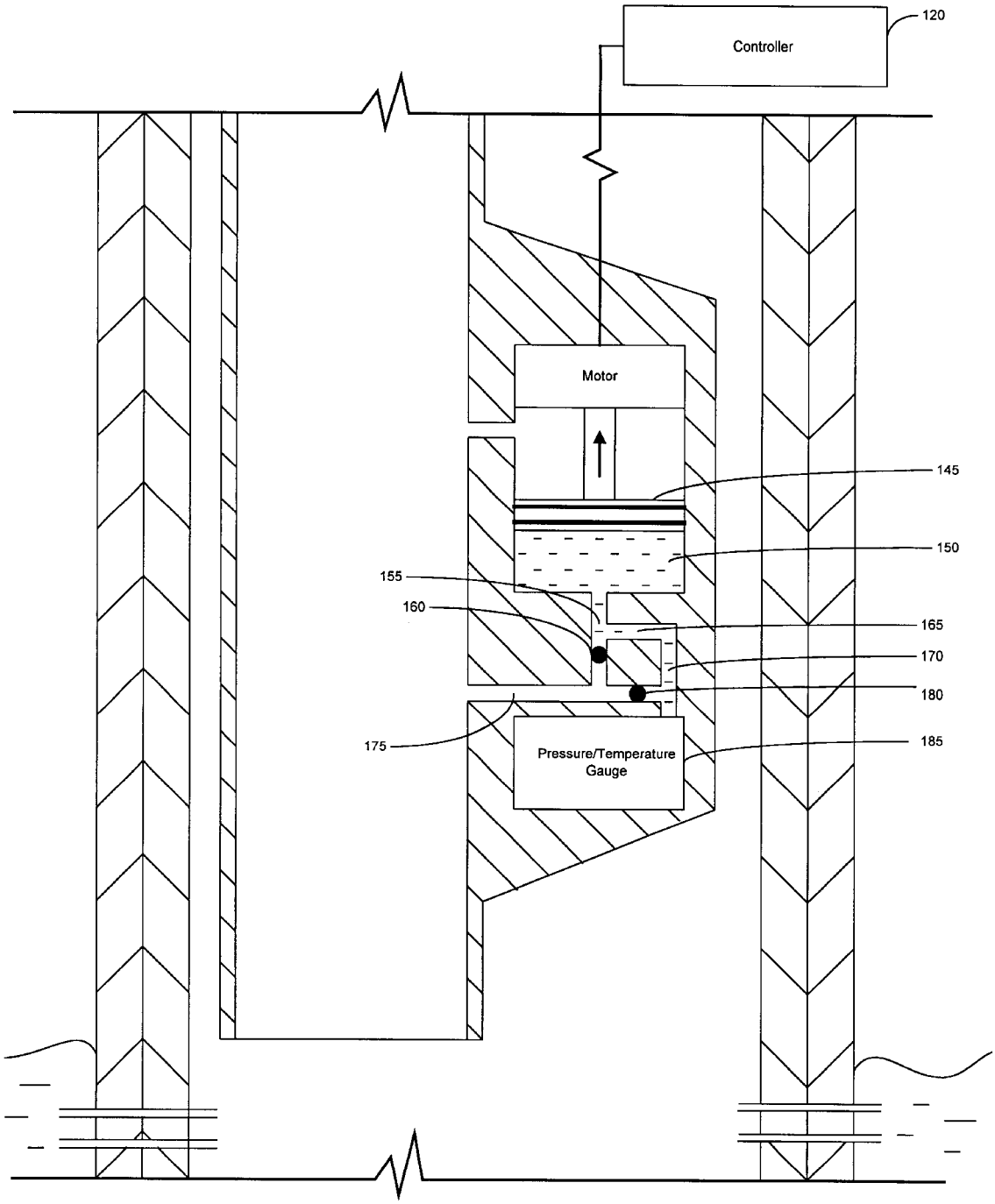
FIG. 4 depicts a fragmentary cross-sectional view of the preferred embodiment of FIG. 1 during sample chamber expansion.

Referring to FIG. 4, after sample collection, the controller 120 remotely closes the first solenoid valve 160 to confine the sample fluid within the sample chamber 150 and the flow lines 155, 165, 170, and 175 bounded by the closed solenoid valves 160 and 180. The controller 120 then incrementally moves the piston 145 upward, thereby increasing the volume of the sample chamber 150. As the controller 120 incrementally moves the piston 145, the pressure/temperature gauge 185 continuously measures the pressure and temperature of the sample contained within the sample chamber 150.

Figure 5:
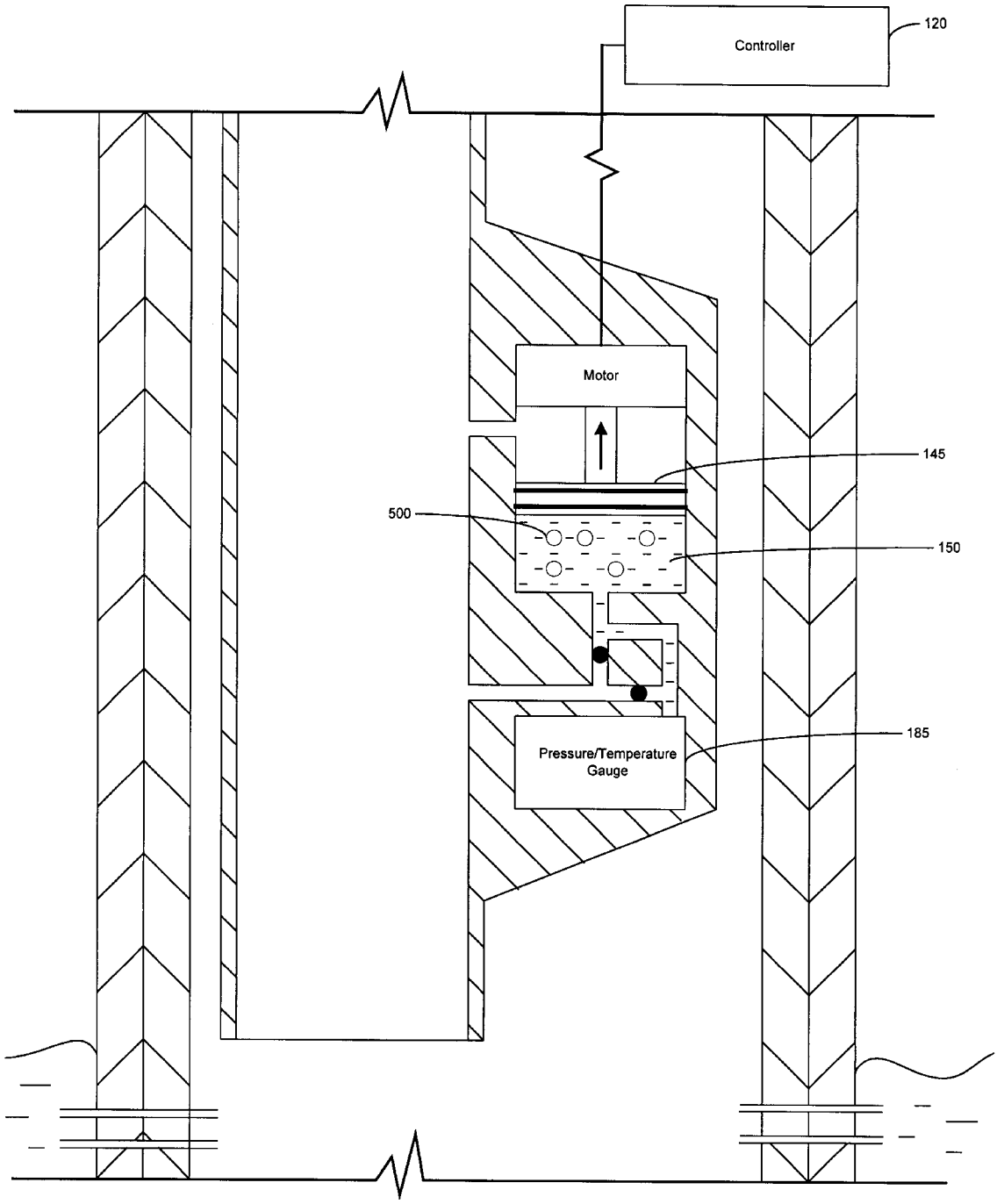
FIG. 5 depicts a fragmentary cross-sectional view of the preferred embodiment of FIG. 1 after further sample chamber expansion.

Referring to FIG. 5, when the sample chamber 150 volume is increased, such that the pressure of the sample of fluid is less than the bubble point pressure of the fluid, gas 500 in the sample of fluid releases from solution, thereby forming a two phase mixture of liquid and gas 500.

During sample chamber 150 expansion, the controller 120 remotely monitors the temperature and pressure measurements made by the pressure/temperature gauge 185. The controller 120 also calculates the volume of the sample fluid based on the position of the piston 145 within the sample chamber 150. After sufficient pressure and volume data has been collected, the controller 120 determines the real time bubble point pressure and compressibility of the sample fluid.

Figure 6:
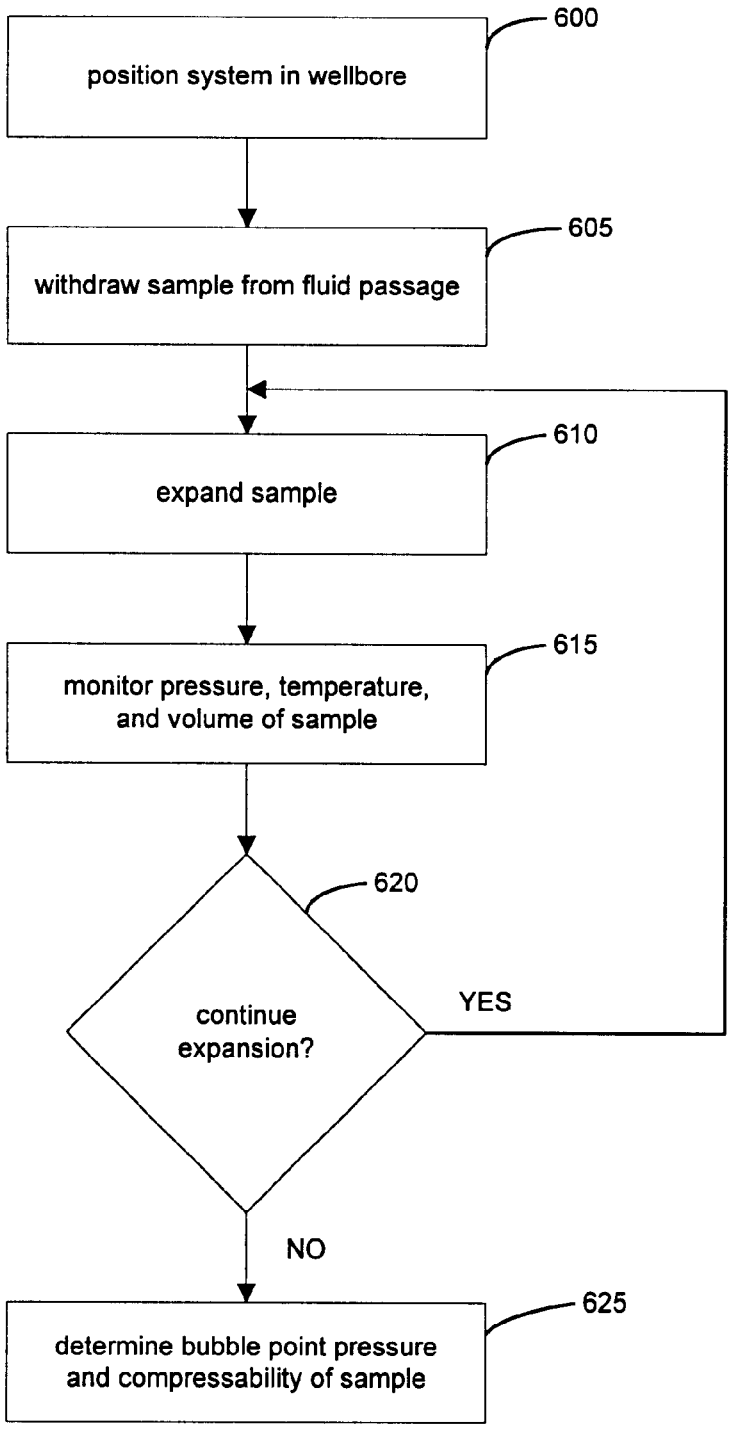
FIG. 6 depicts a flow chart of a preferred embodiment for determining bubble point pressure and compressibility of a fluid originating from a subsurface earth formation.

Referring to FIG. 6, a method for determining the real time bubble point pressure and compressibility of a fluid originating from a subsurface earth formation begins with a step 600. In step 600, an operator positions the system 100 in the wellbore 200. In step 605, the controller 120 remotely opens the first solenoid valve 160, closes the second solenoid valve 180, and vertically moves the piston 145 upward to withdraw a sample of fluid from the fluid passage 125 into the sample chamber 150. In step 610, the sample is confined to the sample chamber, and expanded as the controller vertically moves the piston 145 upward. In step 615, the controller 120 monitors the pressure, temperature, and volume of the sample. In step 620, the controller 120 determines whether further sample expansion is necessary. Further sample expansion will be necessary if additional data points are needed to make the requisite calculations. If further expansion is necessary, the method repeats steps 610 and 615. If further expansion is not necessary, then in step 625, the controller 120 determines the bubble point pressure and compressibility of the sample.

Figure 7:
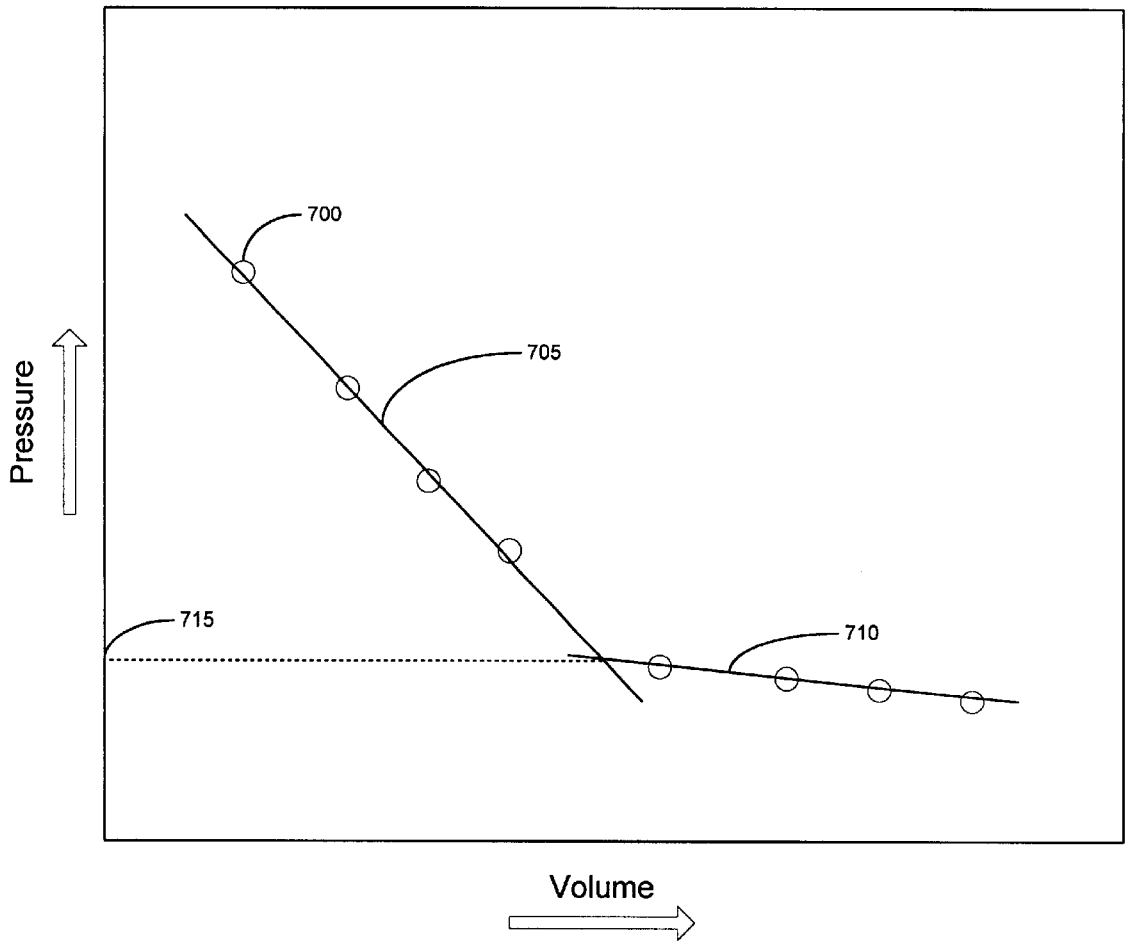
FIG. 7 depicts a plot of pressure as a function of volume.

Referring to FIG. 7, a graphic representation of pressure and volume data collected by the system 100 includes a plot of sample fluid pressure as a function of volume data 700. The data 700 exhibits two different linear slopes. A first best-fit line 705, drawn through the data 700, exhibits a first slope. A second best-fit line 710, drawn through the data 700, exhibits a second, smaller slope. The first best-fit line 705 corresponds to pressures at which the sample fluid is a single phase liquid. The second best-fit line 710 corresponds to pressures at which the sample fluid is a two phase gas-liquid mixture. The bubble point pressure 715 of the sample fluid corresponds to the pressure at which the first best-fit line and the second best-fit line intersect. The compressibility of the sample of wellbore fluid, at a particular pressure and volume, is calculated using the following formula:

$$\text{compressibility} = -\frac{1}{V_2} \times \frac{(V_2 - V_1)}{(P_1 - P_2)}$$

where, $V_1$=volume at higher pressure $V_2$=volume at lower pressure $P_1$=higher pressure $P_2$=lower pressure.

It is understood that several variations may be made in the foregoing without departing from the scope of the invention. For example, the downhole device 115 may be operated without a wireline 130. In such a configuration, the downhole device 115 may be operated using a memory tool that is attached to the downhole device 115 in the wellbore 200, and retrieved at a later time. Alternatively, the downhole device 115 may be remotely operated with a transmitter.

Although illustrative embodiments of the invention have been shown and described, a wide range of modifications, changes, and substitutions is contemplated in the foregoing disclosure. In some instance, some features of the present invention may be employed without a corresponding use of the other features. Accordingly, it is appropriate that the appended claims be construed broadly, and in a manner consistent with the scope of the invention.

What is claimed is:

1. A system for determining the real time bubble point pressure of a fluid originating from a subsurface earth formation, comprising:

a. a production tubing adapted to facilitate the flow of fluid to the surface;

b. a side pocket coupled to the production tubing, adapted to contain a downhole device;

c. a downhole device positioned within the side pocket, adapted to expand a sample of fluid, and measure the temperature and pressure of the sample of fluid; and d. a controller operably coupled to the downhole device, adapted to monitor the temperature, pressure, and volume of the sample of fluid, and determine the bubble point pressure of the fluid based on the pressure and volume measurements.

2. A system for determining the real time compressibility of a fluid originating from a subsurface earth formation, comprising:

a. a production tubing adapted to facilitate the flow of fluid to the surface;

b. a side pocket coupled to the production tubing, adapted to contain a downhole device;

c. a downhole device positioned within the side pocket, adapted to expand a sample of fluid, and measure the temperature and pressure of the sample of fluid; and d. a controller operably coupled to the downhole device, adapted to monitor the temperature, pressure, and volume of the sample of fluid, and determine the compressibility of the fluid based on the pressure and volume measurements.

* * * * *

UNITED STATES PATENT AND TRADEMARK OFFICE

CERTIFICATE OF CORRECTION

PATENT NO. : 6,334,489 B1
DATED : January 1, 2002
INVENTOR(S) : Than Shwe, Mike Flecker, Steve Thompson and Roy Torrance It is certified that error appears in the above-identified patent and that said Letters Patent is hereby corrected as shown below:

Title page,
Please delete the Assignee's name and substitute:
"[73] Assignee: Wood Group Logging Services Holding Inc., Houston TX (US)" with -- [73] Assignee: Wood Group Logging Services Holdings Inc., Houston TX (US) --

Signed and Sealed this

Twenty-first Day of May, 2002

*Attest:*

*Attesting Officer*

JAMES E. ROGAN
*Director of the United States Patent and Trademark Office*